US005353206A

United States Patent [19]

Fejes

[11] Patent Number: 5,353,206

[45] Date of Patent: Oct. 4, 1994

[54] IN-GROUND STORAGE CONTAINER

[76] Inventor: James M. Fejes, 1541 W. Crone Ave., Anaheim, Calif. 92802

[21] Appl. No.: 78,925

[22] Filed: Jun. 21, 1993

[51] Int. Cl.[5] ..... B65D 43/16; F21V 33/00

[52] U.S. Cl. ..... 362/154; 362/153; 362/394; 220/23.83; 220/410; 220/484; 220/528; 220/242; 220/210

[58] Field of Search ..... 220/23.83, 408, 410, 220/484, 528, 342, 343, 909, 210; 52/169.6, 98; 362/154, 153.1, 153, 394

[56] References Cited

U.S. PATENT DOCUMENTS 705,551 7/1902 Bauers ..... 220/23.83
2,546,590 3/1951 Ferrel ..... 220/342
4,033,476 7/1977 Greenquist ..... 220/342
4,158,102 6/1979 Bright ..... 220/484
5,143,246 9/1992 Johnson et al. ..... 220/23.83

*Primary Examiner*—Ira S. Lazarus
*Assistant Examiner*—Thomas Sember
*Attorney, Agent, or Firm*—E. Michael Combs

[57] ABSTRACT

A container arranged for the storage of various components for emergency use relative to natural disasters is provided, wherein the container structure is of a generally pyramidal configuration having removable storage housings positioned therewithin. The storage container includes a lid member that is arranged for latching relative to the storage container permitting limited access thereto.

4 Claims, 4 Drawing Sheets

FIG. 5
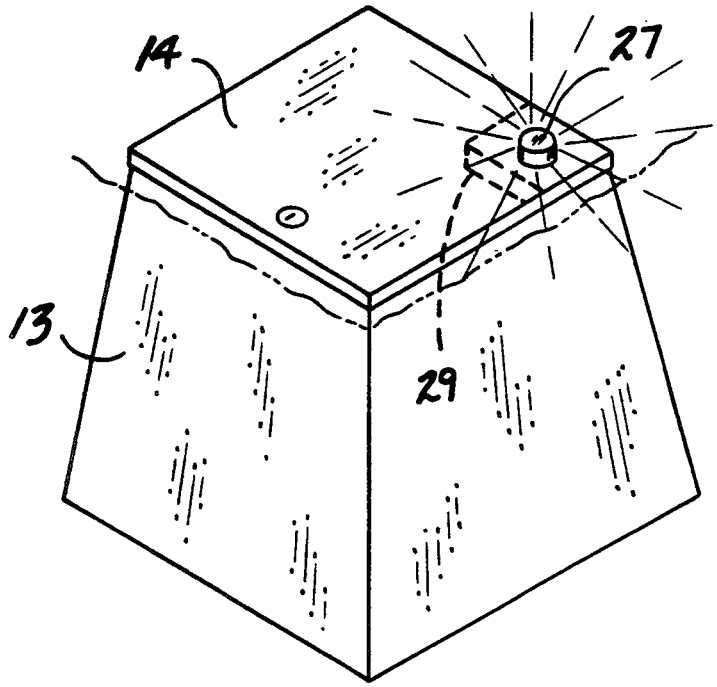
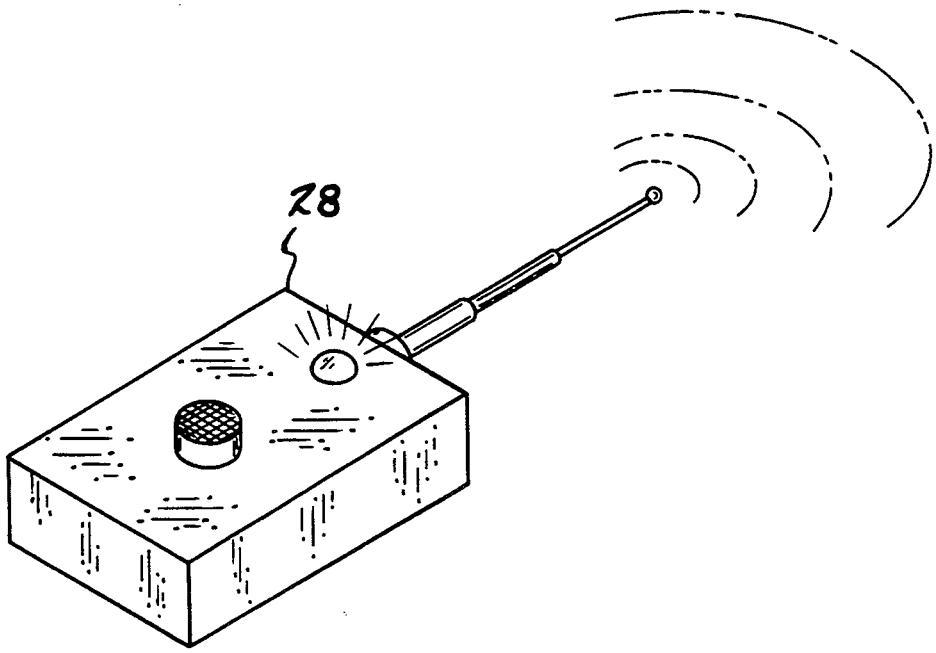
FIG. 6

FIG. 7
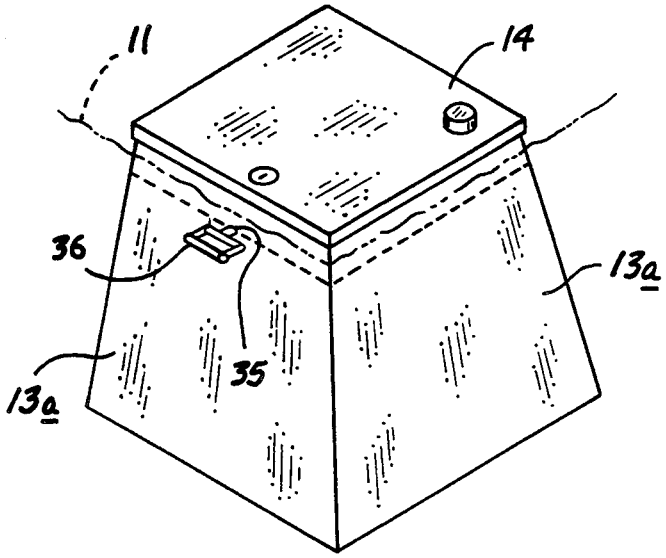
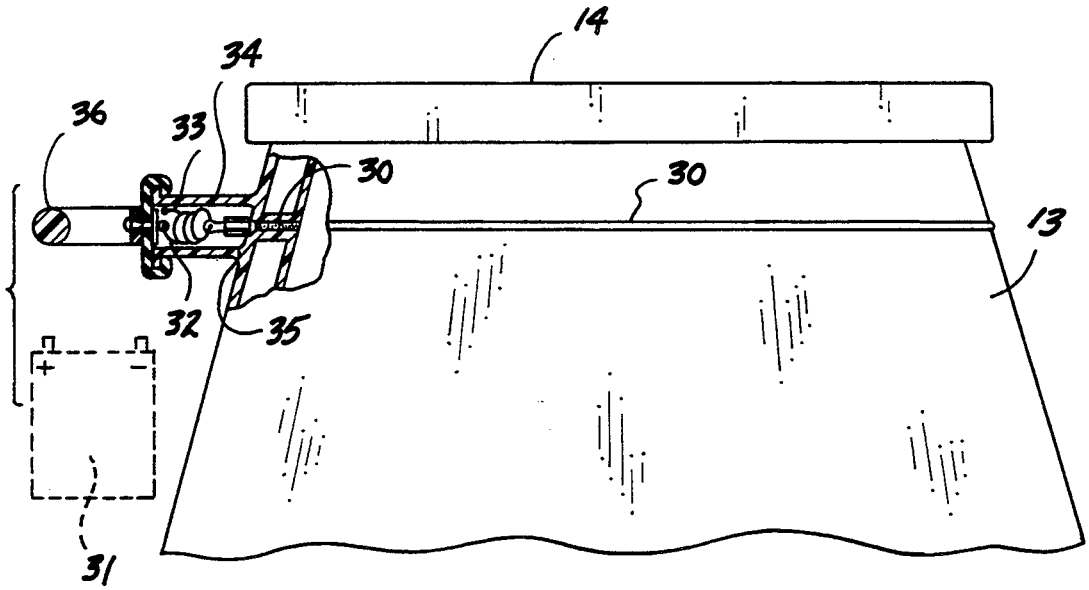
FIG. 8

IN-GROUND STORAGE CONTAINER

BACKGROUND OF THE INVENTION

1. Field of the Invention

The field of invention relates to container apparatus, and more particularly pertains to a new and improved in-ground storage container wherein the same is arranged for the storage and containment in a hermetically sealed manner of necessities such as food, water, first aid supplies, and the like.

2. Description of the Prior Art

Storage containers of various types have been utilized in the prior art such as compartmentalized containers available and indicated in U.S. Pat. Nos. 4,573,751 and 4,615,571.

The instant invention is directed to overcome deficiencies of the prior art by providing for a storage container having hermetically sealed cavity for the containment of various emergency components relative to a natural disaster and the like and in this respect, the present invention substantially fulfills this need.

SUMMARY OF THE INVENTION

In view of the foregoing disadvantages inherent in the known types of container structure now present in the prior art, the present invention provides an in-ground storage container wherein the same employs a pyramidal container structure preventing shifting of the container when mounted within a subterranean manner. As such, the general purpose of the present invention, which will be described subsequently in greater detail, is to provide a new and improved in-ground storage container which has all the advantages of the prior art container structure and none of the disadvantages.

To attain this, the present invention provides a container arranged for the storage of various components for emergency use relative to natural disasters, wherein the container structure is of a generally pyramidal configuration having removable storage housings positioned therewithin. The storage container includes a lid member that is arranged for latching relative to the storage container permitting limited access thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved in-ground storage container which has all the advantages of the prior art container structure and none of the disadvantages.

It is another object of the present invention to provide a new and improved in-ground storage container which may be easily and efficiently manufactured and marketed.

It is a further object of the present invention to provide a new and improved in-ground storage container which is of a durable and reliable construction.

An even further object of the present invention is to provide a new and improved in-ground storage container which is susceptible of a low cost of manufacture with regard to both materials and labor, and which accordingly is then susceptible of low prices of sale to the consuming public, thereby making such in-ground storage containers economically available to the buying public.

Still yet another object of the present invention is to provide a new and improved in-ground storage container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the container including a visual alarm member.

FIG. 6 is an isometric illustration of a transmitter arranged for association with the alarm structure of FIG. 5.

FIG. 7 is an isometric illustration of the invention further employing an optional fusable interconnection of the side walls adjacent the lid.

FIG. 8 is an enlarged orthographic view, partially in section, of the fusable link structure as indicated in FIG. 7.

DESCRIPTION OF THE PREFERRED EMBODIMENT

Figure 1:
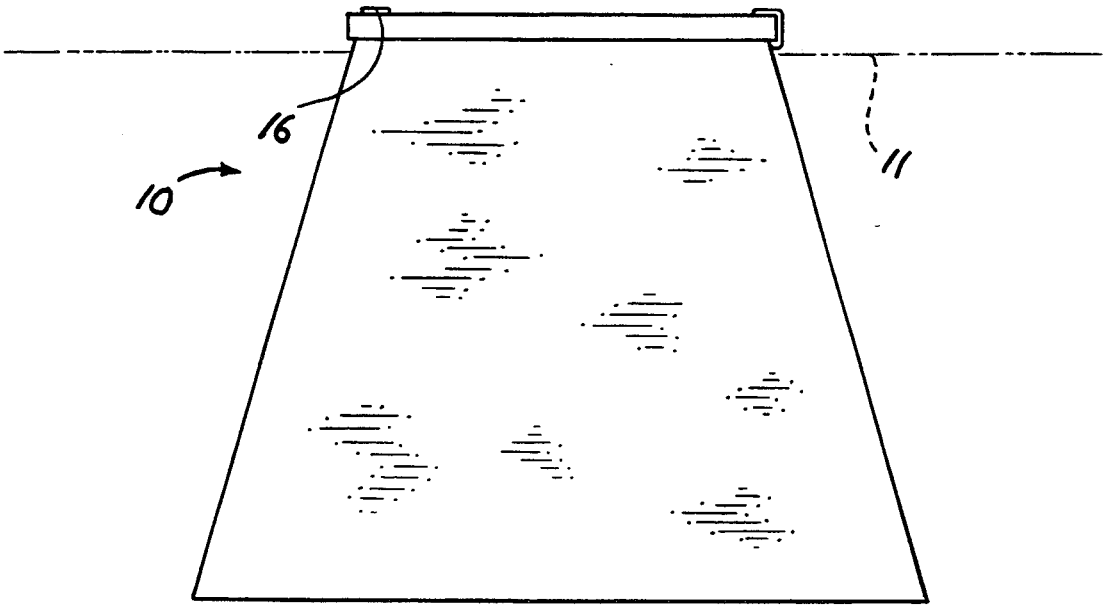
FIG. 1 is an orthographic view of the invention.

With reference now to the drawings, and in particular to FIGS. 1 to 8 thereof, a new and improved in-ground storage container embodying the principles and concepts of the present invention and generally designated by the reference numeral 10 will be described.

Figure 2:
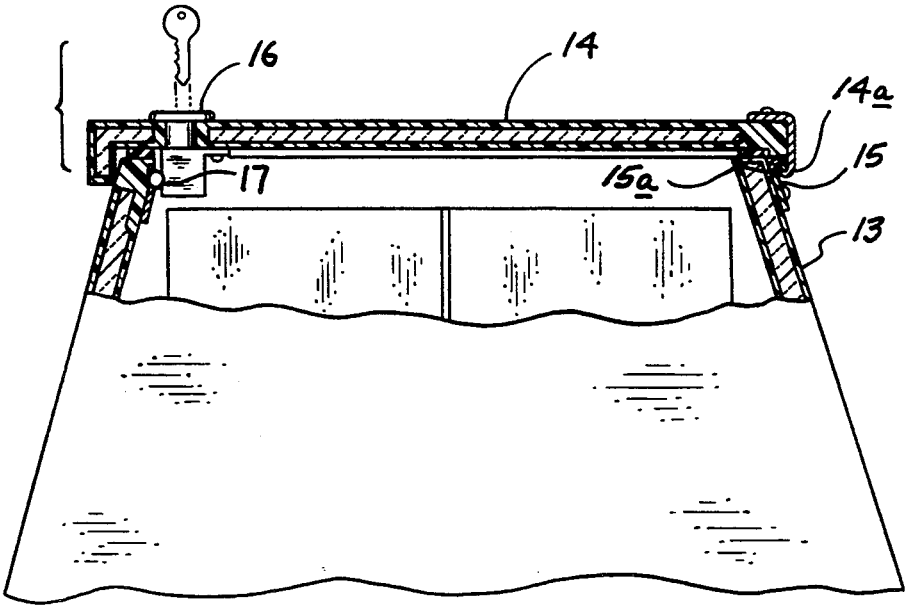
FIG. 2 is an orthographic view, partially in section, of the invention indicating the lid structure.

More specifically, the in-ground storage container 10 is of a generally truncated pyramidal configuration, having a container floor 12 and container side walls 13 extending from the floor, with a lid 14 hingedly mounted by a lid hinge 15 to one of the side walls 13 within opposing one of the side walls, including a latch receiving structure 16 to receive a latch lug 17 rotated by means of the key structure, as indicated in FIG. 2. The container is arranged for positioning below ground level 11, as indicated in FIG. 1, wherein the pyramidal configuration prevents displacement of the container and its shifting. Such natural phenomenon as earth quakes and the like present a danger in limited access to such life-saving components as food, water, radio, and the like that is contemplated for storage within the container structure. It should be noted that the lid hinge 15 includes a U-shaped hinge first lip 15*a* arranged for cooperation with a lid U-shaped hinge second lip 14*a* that is mounted to the side wall 13*a*, as illustrated in FIG. 2, to permit separation of the first lip 15*a* relative to the second lip 14*a* in removal of the lid 14 relative to the container structure.

Figure 3:
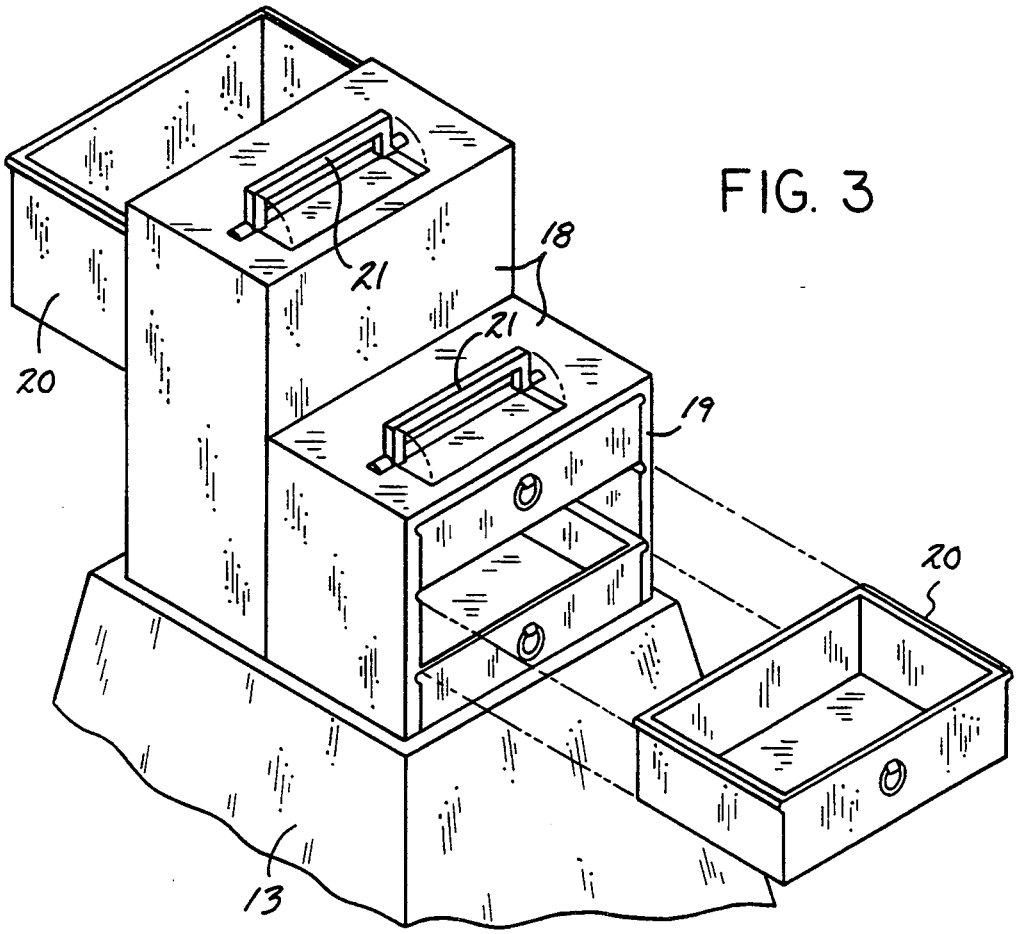
FIG. 3 is an isometric illustration of the invention including the removable storage housings.
Figure 4:
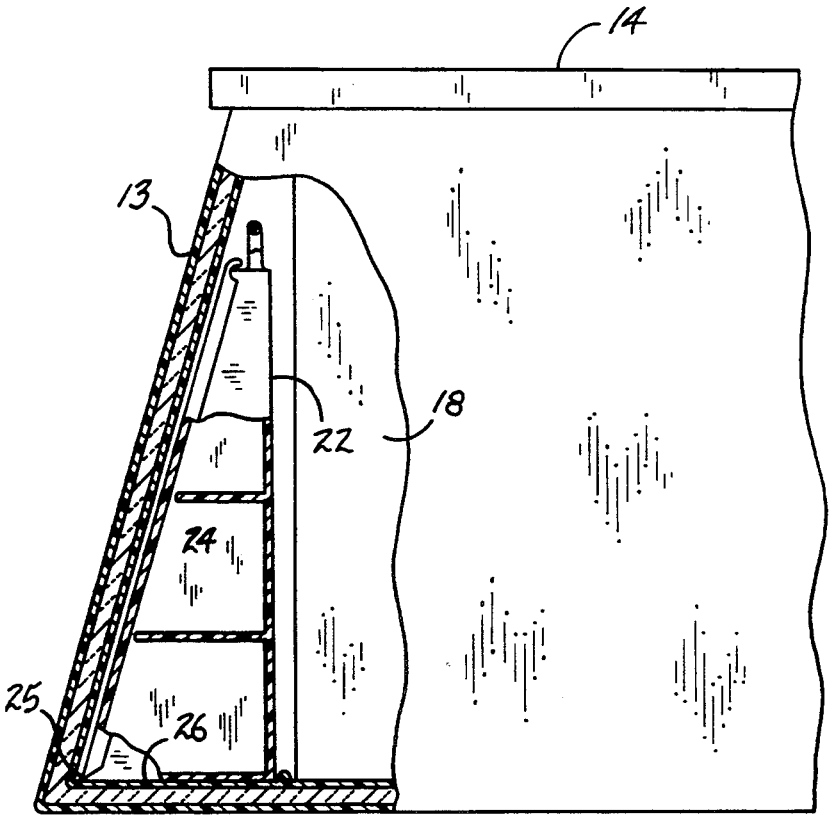
FIG. 4 is an orthographic view, partially in section, of a further storage housing mounted within the container.

The FIG. 3 indicates the use of a plurality of central storage housings 18 arranged in back-to-back relationship, each of a generally parallelepiped configuration extending from the container floor 12 within the container cavity, such that each of the storage housings 18 includes a housing front wall 19, including slide drawers 20, with the storage housing having a storage housing top wall, having a handle 21 for ease of removal of each storage housing. As indicated in FIG. 4, the floor within the cavity of the container includes a floor rib 23 arranged to separate the central storage housing 18 relative to an outer storage housing 22 of a generally triangular cross-sectional configuration, including an outer housing front panel 24 mounted to the outer housing floor 26 about a front panel hinge 25 to provide for enhanced utilization within the cavity of the container structure.

The FIG. 5 indicates the use of an optional illumination member 27 to indicate a visual alarm that projects through the lid 14 in cooperation with a radio receiver 29 operative through a transmitter 28 (see FIG. 6), wherein the transmitter 28 effects selective actuation of the illumination member 27 to enhance ease of locating the container structure subsequent to an emergency condition.

The FIGS. 7 and 8 include the additional construction of the invention having modified side walls 13*a*, with each side wall including a portion of a continuous fusable link 30. The fusable link 30 is parallel to and adjacent the lid 14, including communication electrically with a link wire housing 34 that is joined to a forward one of the side walls 13*a* at a frangible junction 35. A handle 36 mounted fixedly to the link wire housing 34 permits ease of separation of the link wire housing for exposure of the respective first and second fusable link wires 32 and 33 that when connected to a battery 31 effect destruction of the fusable link continuous layer 30 for access interiorly of the container should the lid be jammed, the key lost, and the like. Typically, the link wire housing 34 and the handle 36 are positioned below the ground level 11, wherein only an owner and the like of the container structure is availed of the knowledge of access to the interior contents of the housing by destruction of the fusable link layer 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An in-ground storage container, comprising, a container having a truncated, pyramidal configuration, including a container floor, and a plurality of container side walls, and a container lid, the lid including a lid hinge hingedly mounting said lid to one of said side walls, the lid including a lid latch mounted to said lid spaced from said lid hinge for cooperation with a further one of said side walls, wherein a further one of said side walls and the one of said side walls are arranged in a facing mirror image relationship relative to one another, and said lid hinge includes a generally U-shaped first lip mounted to said lid, and a generally U-shaped second lip mounted to said one of said side walls permitting ease of separation of said lid from said one of said side walls, the lid including a lid latch arranged for securement to said further one of said side walls, and a plurality of central storage housings removably mounted relative to said container positioned within said container, wherein each storage housing includes a storage housing front wall, and each storage housing front wall includes a plurality of slide drawers removably mounted relative to said storage housing front wall, with each storage housing including a storage housing top wall having a top wall handle.

2. A container as set forth in claim 1 wherein the container floor includes a floor rib and an outer storage housing, wherein said floor rib is positioned intermediate said outer storage housing and one of said central housings, and wherein said outer storage housing is of a generally triangular configuration having a outer housing front panel and an outer housing floor, wherein the outer housing front panel includes an outer housing front panel hinge hingedly mounting said outer housing front panel to said outer housing floor.

3. A container as set forth in claim 1 including a receiver mounted to said lid, with an illumination member projecting through said lid exteriorly of said lid, and a transmitter arranged for actuation of said receiver to effect illumination of said illumination member.

4. A container as set forth in claim 3 including a continuous fusable link layer directed through each of said side walls, wherein the fusable link layer includes a first fusable link wire and a second fusable link wire projecting from said further one of said side walls, and a link wire housing receiving said first fusable link wire and said second fusable link wire, the link wire housing is mounted to from said further one of said side walls at a frangible junction to permit ease of separation of said link wire housing relative to from said further one of said side walls permitting exposure of said first fusable link wire and said second fusable link wire, and a battery arranged for communication to said first fusable link wire and said second fusable link wire to effect destruction of said fusable link layer.

* * * * *